US008413460B2

(12) United States Patent
Yang et al.

(10) Patent No.: US 8,413,460 B2
(45) **Date of Patent: *Apr. 9, 2013**

(54) LEVER FOR DISPENSER AND REFRIGERATOR HAVING THE SAME

(75) Inventors: Yun Ho Yang, Yongin (KR); Sang Woon Jeon, Namyangju (KR); Jae Moon Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 338 days.

This patent is subject to a terminal disclaimer.

(21) Appl. No.: 12/820,584

(22) Filed: Jun. 22, 2010

(65) Prior Publication Data

US 2010/0319389 A1 Dec. 23, 2010

Related U.S. Application Data

(63) Continuation-in-part of application No. 12/656,511, filed on Feb. 1, 2010.

(30) Foreign Application Priority Data

Jun. 22, 2009 (KR) ..... 10-2009-55376
Jun. 18, 2010 (KR) ..... 10-2010-58010

(51) Int. Cl.
*F25D 3/00* (2006.01)

(52) U.S. Cl. ..... 62/389

(58) Field of Classification Search ..... 62/389, 62/440, 448, 449; 74/519, 43, 141.5; 141/362, 141/344; 222/75, 402.15
See application file for complete search history.

(56) References Cited

U.S. PATENT DOCUMENTS

| | | | | |
|---|---|---|---|---|
| 2004/0183414 | A1* | 9/2004 | Kwon | 312/401 |
| 2004/0188466 | A1* | 9/2004 | Choi | 222/146.6 |
| 2006/0131324 | A1* | 6/2006 | Noh et al. | 221/150 R |
| 2006/0175356 | A1* | 8/2006 | Takahashi et al. | 222/391 |
| 2006/0179869 | A1* | 8/2006 | Lee et al. | 62/340 |
| 2006/0196214 | A1* | 9/2006 | Lee et al. | 62/344 |
| 2006/0201192 | A1* | 9/2006 | Bowen et al. | 62/344 |
| 2006/0201193 | A1* | 9/2006 | Bowen et al. | 62/344 |
| 2007/0102447 | A1* | 5/2007 | Fulton et al. | 222/144.5 |
| 2007/0251261 | A1* | 11/2007 | Son et al. | 62/390 |
| 2008/0053139 | A1* | 3/2008 | Park et al. | 62/344 |
| 2008/0072612 | A1* | 3/2008 | Park et al. | 62/187 |
| 2008/0156005 | A1* | 7/2008 | Culley et al. | 62/132 |
| 2008/0156011 | A1* | 7/2008 | Culley et al. | 62/228.1 |
| 2008/0174220 | A1* | 7/2008 | Kim et al. | 312/405 |
| 2008/0178626 | A1* | 7/2008 | Jang et al. | 62/344 |

FOREIGN PATENT DOCUMENTS

| | | |
|---|---|---|
| KR | 10-2004-0083561 | 10/2004 |
| KR | 10-0794601 | 1/2008 |
| KR | 10-2008-0072998 | 8/2008 |

* cited by examiner

*Primary Examiner* — Mohammad Ali
(74) *Attorney, Agent, or Firm* — Staas & Halsey LLP

(57) ABSTRACT

A refrigerator having an operation lever for a dispenser includes first and second levers interconnected to perform respectively different functions. At least one of the first and second levers is moved relative to the other one. Accordingly, the operability and the aesthetic appearance of the refrigerator may be improved.

24 Claims, 17 Drawing Sheets

LEVER FOR DISPENSER AND REFRIGERATOR HAVING THE SAME

CROSS-REFERENCE TO RELATED APPLICATIONS

This application is a Continuation-in-part of prior application Ser. No. 12/656,511, filed on Feb. 1, 2010 in the U.S. Patent and Trademark Office, the disclosure of which is herein incorporated in its entirety by reference. This application claims the benefit of Korean Patent Application No. 2009-0055376, filed on Jun. 22, 2009 in the Korean Intellectual Property Office, and Korean Patent Application No. 2010-0058010, filed on Jun. 18, 2010, in the Korean Intellectual Property Office, the disclosures of which are incorporated herein in their entirety by reference.

BACKGROUND

1. Field

One or more embodiments relate to an operation lever for a dispenser to optionally take out water or ice, and a refrigerator having the same.

2. Description of the Related Art

Generally, a refrigerator refers to a device to preserve food at a low temperature by supplying a cold air to a food storage chamber divided into a freezing chamber maintaining temperature under the freezing point and a refrigerating chamber maintaining temperature a little above the freezing point.

Recently, refrigerators have been developed to have a dispenser at a front side of a door so that ice or water is optionally taken out, for convenience.

The dispenser has a taking-out opening through which ice or water is discharged to a taking-out space, and a lever dedicatedly installed to operate the taking-out opening. That is, water and ice are taken out according to the operation of the lever disposed at a lower part of the respective taking-out opening.

In the dispenser, a single lever or a lever function conversion button may be provided for more efficient use of the taking-out space. More specifically, an object to be taken out is selected through the button and accordingly ice or water is optionally taken out to one taking-out space by the operation of the lever.

SUMMARY

Therefore, it is an aspect of one or more embodiments to provide a refrigerator with an operation lever for a dispenser, having improved operability, convenience of use, and an aesthetic appearance.

Additional aspects and/or advantages will be set forth in part in the description which follows and, in part, will be apparent from the description, or may be learned by practice of the embodiments.

In accordance with one aspect of one or more embodiments, an operation lever for a dispenser includes a first lever and a second lever interconnected to press a first switch and a second switch, respectively, and an interconnection of the first lever and the second lever provides operation of the first lever without moving the second lever upon only the first lever being pushed to press the first switch and provides the second lever being moved along with the first lever upon the second lever being operated to press the second switch.

The operation lever may further include a rotational shaft to which the first and the second levers are rotatably connected, and the second lever is formed to have a shorter length than the first lever and disposed in front of the first lever.

The operation lever may further include a first elastic member elastically supporting the first lever to return the first lever to an initial position after being rotated, and a second elastic member elastically supporting the second lever in an opposite direction to the rotational direction of the first lever to restrict rotation of the second lever while the first lever is rotating.

The first lever may include a cut part opened to one side, and a locking protrusion formed along an inner edge of the cut part to be supported by a supporting part recessed along an edge of the second lever.

The second lever may be rotated about a rotational shaft, and the first lever may be connected to be rotated along with and slid with respect to the second lever.

The second lever may include a cut part opened to an upper part thereof and guide rails formed on both inner sidewalls of the cut part, and the first lever comprises slide grooves engaged with the guide rails.

The operation lever may further include a first elastic member to return the second lever in a rotated state to an initial state, and a second elastic member to return the first lever in a moved state to an initial position.

According to another aspect of one or more embodiments, an operation lever for a dispenser, comprising a first lever to rotate about a first rotational shaft, a second lever to rotate about a second rotational shaft, the second lever being formed to have a shorter length than the first lever while being disposed in front of the first lever, first and second elastic members to elastically support the first and second levers such that the first and second levers are returned to initial positions thereof after rotating, respectively, and first and second switches to be pressed by the first and second levers when the first and second levers rotate, respectively.

In accordance with another aspect of one or more embodiments, a refrigerator may include a main body equipped with a storage chamber, a door opening and closing the storage chamber, a dispenser formed at one side of the door to enable taking-out of beverage and ice from outside, first and second switches formed at one side of the dispenser for taking-out of the beverage and ice, and an operation lever pressing the first and second switches, wherein the operation lever includes a first lever and a second lever rotatable to press the first and second switches, wherein the second lever does not rotate even when the first lever presses the first switch, wherein the second lever presses the first lever as the second lever rotates to press the second switch, wherein the second lever rotates along with the first lever as the second lever presses the first lever.

The refrigerator may further include first and second elastic members to return the first and second levers to initial positions thereof after rotating, respectively, the first and second elastic members being coupled to respective rotational shafts of the first and second levers.

The first and second switches may be disposed at a rear upper portion of a taking-out space of the dispenser. The first and second operation arms may be disposed at back surfaces of the first and second levers while extending toward the first and second switches, respectively.

The second lever may include a partially-opened cut part formed at one side of the first lever. The second operation arm may extend toward the second switch while extending through the cut part.

The refrigerator may further include an illuminator to illuminate a taking-out space of the dispenser, and a sensor to sense approach of an object into the taking-out space. The illuminator may be operatively connected to the sensor.

In accordance with a further aspect of one or more embodiments, a refrigerator may include a main body equipped with a storage chamber, a door opening and closing the storage chamber, a taking-out space disposed at one side of the door, an ice discharging pipe and an intake port disposed at an upper part of the taking-out space to discharge ice and beverage, respectively, a first lever rotatably mounted in the taking-out space to press a first switch formed at one side of the taking-out space and thereby to discharge beverage to the intake port, and a second lever mounted at a lower part of the ice discharging pipe and moved in an up and down direction to press a second switch formed at one side of the ice discharging pipe and thereby to supply ice to the ice discharging pipe.

The ice discharging pipe may have a connection groove for one end of the second lever to reciprocate therein, and the connection groove may have an elastic member to return the second lever in a moved state to an initial position.

The second lever may include a push part formed at one end thereof to push the second lever, and a connection part formed at the other end thereof to be movably inserted in the connection groove and supported by a lower edge of the connection groove.

In accordance with a further aspect of one or more embodiments, an operation lever for a dispenser may include a first lever to press the first switch; and a second lever disposed in front of the first lever, to press the second switch, the second lever being formed to have a shorter length than the first lever, wherein the first lever selectively operates to perform a first function without movement of the second lever, or to perform a second function with simultaneous movement of the first and second levers.

The first and second levers may rotate about rotational shafts thereof, respectively.

The first function may be to dispense beverage, and the second function may be to dispense ice.

The first lever and the second lever may be pushed to be operated.

The operation lever may further include an interconnection providing operation of the first lever without moving the second lever upon only the first lever being operated, and may provide the second lever being moved along with the first lever upon the second lever being operated.

The first and second levers may return to an initial position after being operated.

The first lever may be rotated about a same rotational shaft as the second lever.

In accordance with a further aspect of one or more embodiments, a refrigerator includes a dispenser having a taking-out space to discharge ice and beverage, wherein the dispenser includes a first lever rotatably coupled to an upper portion of the taking-out space, to press a first switch, a second lever rotatably coupled to the upper portion of the taking-out space in front of the first lever, to press the second switch, the second lever having a shorter length than the first lever, an illuminator to illuminate the taking-out space, and a sensor to sense approach of an object into the taking-out space, wherein the illuminator is operatively connected to the sensor.

BRIEF DESCRIPTION OF THE DRAWINGS

These and/or other aspects of the one or more embodiments will become apparent and more readily appreciated from the following description of the embodiments, taken in conjunction with the accompanying drawings of which.

DETAILED DESCRIPTION

Figure 1:
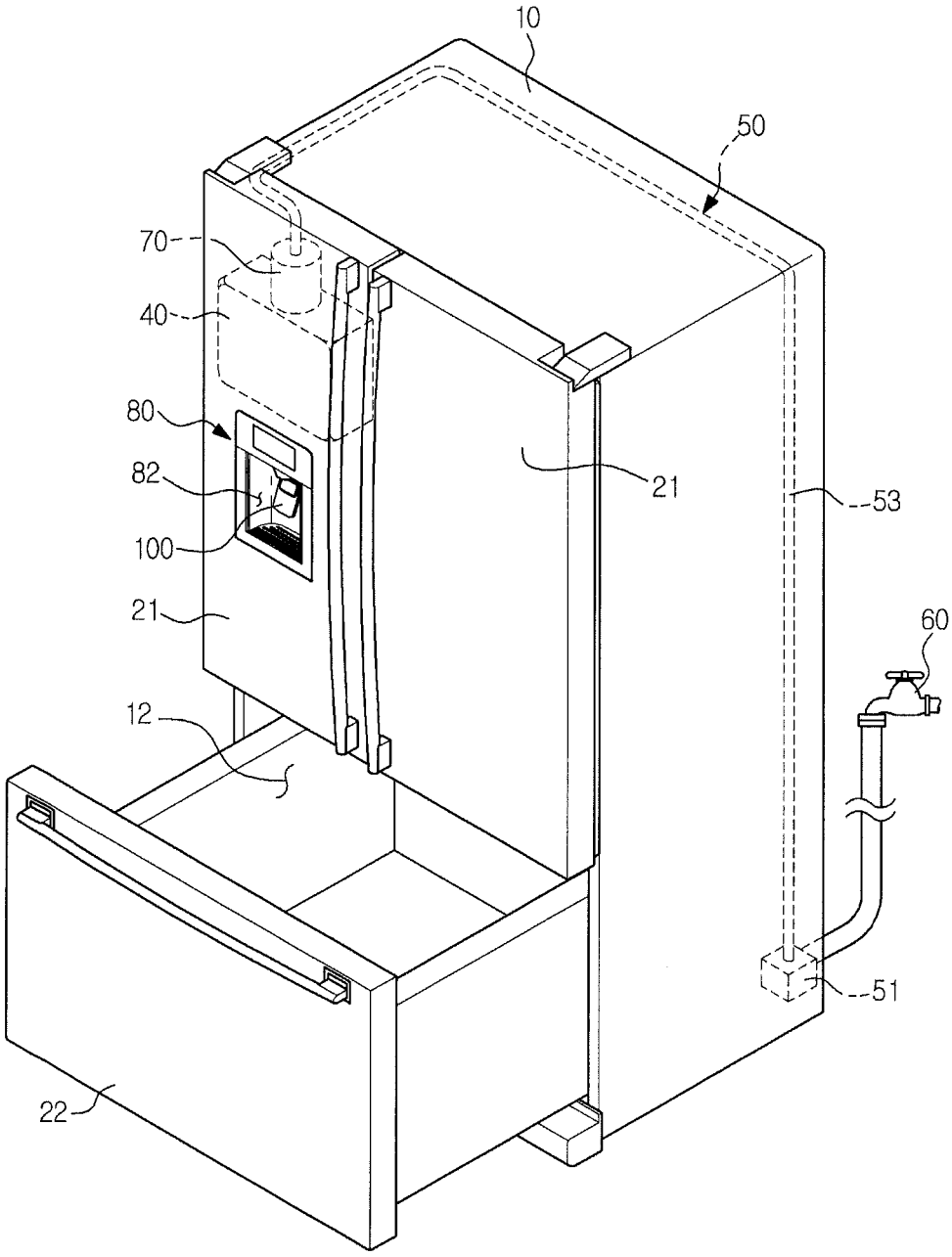
FIG. 1 is a perspective view schematically showing the external appearance of a refrigerator according to an embodiment.

Reference will now be made in detail to one or more embodiments, examples of which are illustrated in the accompanying drawings, wherein like reference numerals refer to like elements throughout.

Hereinafter, a bottom mounted freezer (BMF)-type refrigerator having a freezing chamber at a lower part thereof will be explained. However, since this is only by way of example, one or more embodiments may be applicable to any other types of refrigerators having a dispenser that selectively supplies ice and water.

Figure 2:
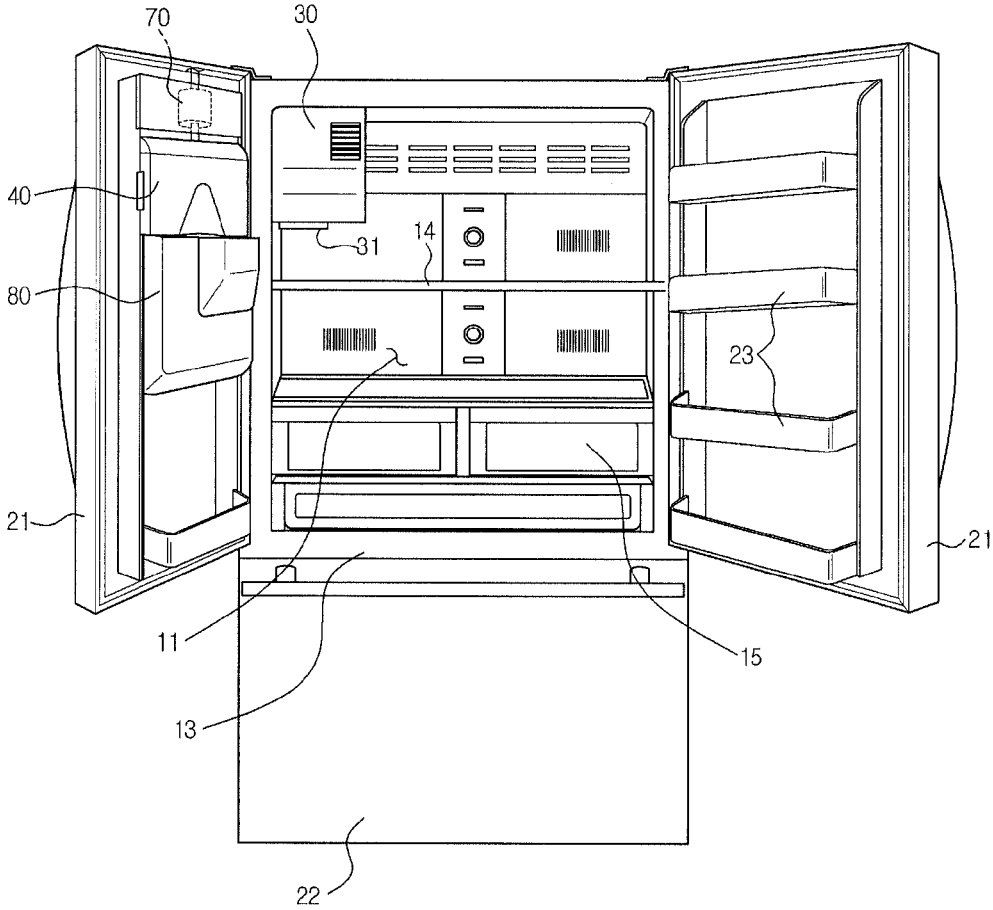
FIG. 2 is a perspective view showing the inside of the refrigerator according to an embodiment.

FIG. 1 is a perspective view schematically showing the external appearance of a refrigerator according to an embodiment and FIG. 2 is a perspective view showing the inside of the refrigerator.

Referring to FIG. 1 and FIG. 2, the refrigerator comprises a main body 10 constituted by storage chambers 11 and 12, and doors 21 and 22 opening and closing a front side of the main body 10.

The storage chambers 11 and 12 may include a refrigerating chamber 11 disposed at an upper part and a freezing chamber 12 disposed at a lower part, being defined by a horizontal partition 13 that divides an inside of the main body 10 up and down.

The refrigerating chamber 11 includes a plurality of shelves 14 disposed at an upper part thereof to put food, and a plurality of containers 15 to store food such as vegetables. In addition, an ice maker 30 to produce ice is installed at one side of the upper part of the refrigerating chamber 11.

Although not shown, the ice maker 30 may be provided with an ice making tray to produce ice therein, an ice storage to store the ice produced by the ice making tray, and an ice feeder to discharge the ice stored in the ice storage to an ice outlet 31.

The doors 21 and 22 include the refrigerating chamber doors 21 opening and closing the refrigerating chamber 11, and a freezing chamber door 22 opening and closing the freezing chamber 12.

A plurality of door guards 23 are formed on the inside of the refrigerating chamber door 21 to store beverage bottles and relatively small items.

Additionally, a dispenser 80 is mounted to the refrigerating chamber door 21 to enable a user to take out water or ice, optionally, from the outside.

The dispenser 80 is connected to a water tank 40 and the ice maker 30 mounted in the refrigerator. The water tank 40 and the ice maker 30 may be connected to the water supplying device 50 that supplies water from an external water supply source 60. The dispenser 80 includes an operation lever 100 in a taking-out space 82.

The water supplying device 50 may include a water supply valve 51 controlling supply of the water from the water supply source 60, and a water supply pipe 53 supplying water to the water tank 40 and the ice maker 30. A filter 70 purifies the water flowing into the water tank 40.

Figure 3:
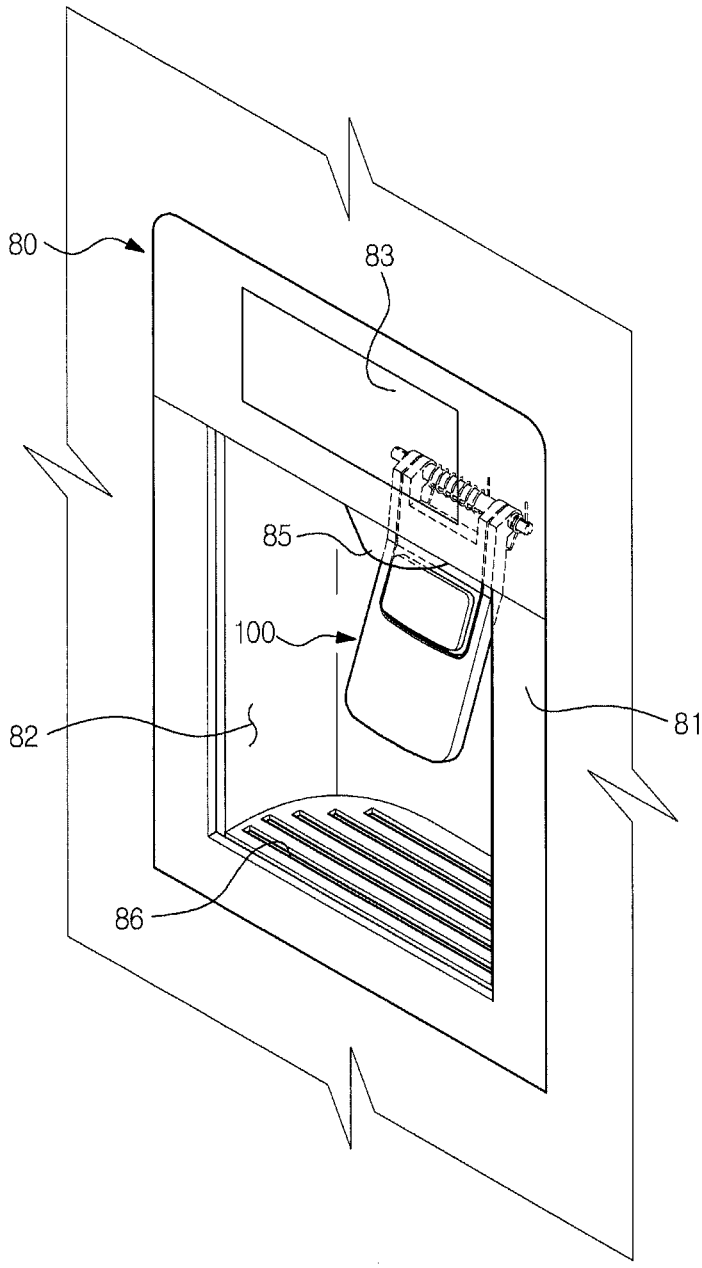
FIG. 3 is a perspective view schematically showing a dispenser of the refrigerator.

FIG. 3 is a perspective view schematically showing the dispenser of the refrigerator, according to an embodiment.

As shown in FIG. 3, the dispenser 80 includes a case 81 forming a taking-out space 82 recessed backward by a predetermined depth from the front side of the refrigerating chamber door 21 (FIG. 1). Also, a control panel 83 is formed at an upper part of the case 81, including a display unit displaying the operation states of the refrigerator and the dispenser 80, and a button unit having function buttons to select type and quantity of ice or water to be taken out.

An intake port 84 (shown in FIG. 6) supplying water from the water tank 40 (FIG. 1) and an ice discharging pipe 85 discharging ice from the ice maker 30 (FIG. 2) are provided at an upper part of the taking-out space 82. A drip reservoir 86 is provided at a lower part of the taking-out space 82 to temporarily hold water dripping during taking-out of the water.

In addition, an operation lever 100 is protruded in the taking-out space 82, which operates the dispenser 80 by being pushed.

The operation lever 100 may be constituted by separate levers respectively for taking-out of ice and water, or a single lever capable of performing different functions without the necessity of dedicatedly selecting functions through a switch.

The user may operate the operation lever 100 in a pushing manner so as to take out water or ice. Upon pushing of the operation lever 100, a taking-out signal may be accordingly transmitted to a control unit (not shown) of the refrigerator. According to this, the water supply valve 51 (FIG. 1) may be opened or an ice discharging device of the ice maker 30 (FIG. 2) may be operated, thereby discharging the object to be taken out, such as the water or ice, through the intake port 84 (shown in FIG. 6) or the ice discharging pipe 85.

Figure 4:
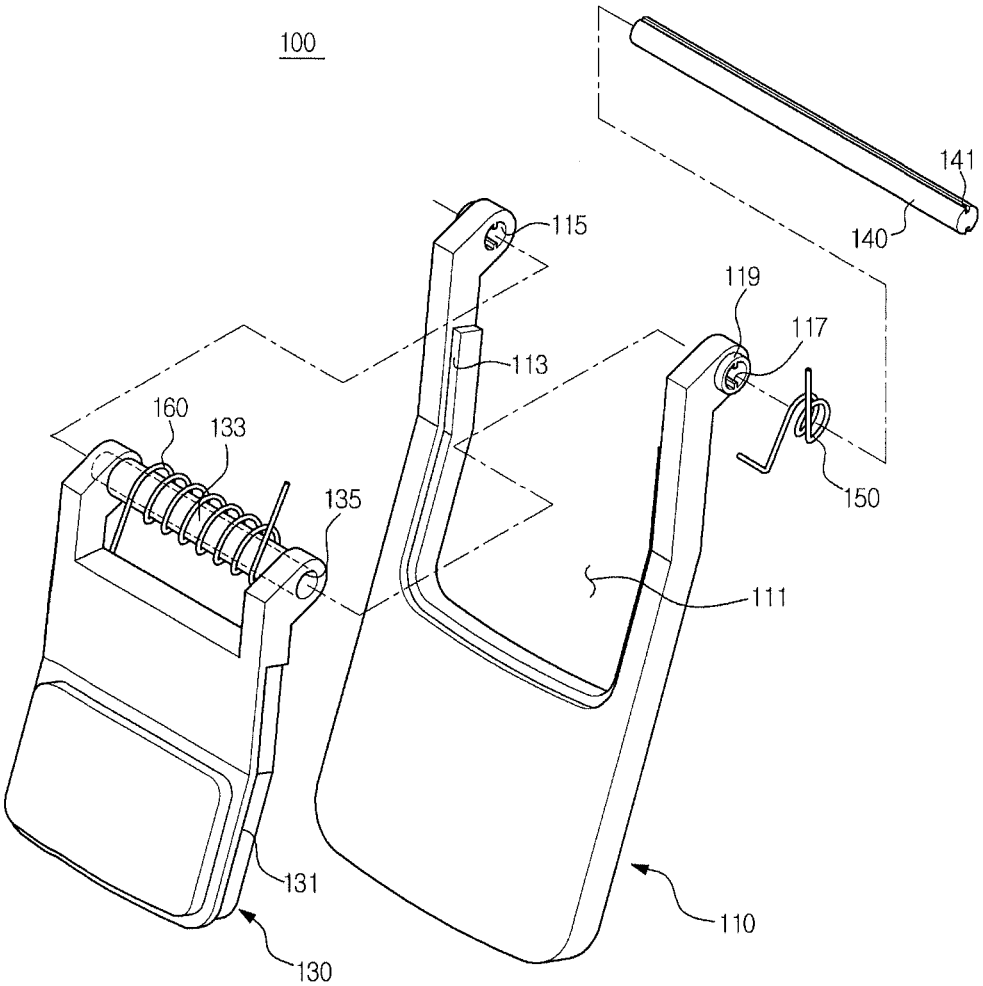
FIG. 4 is an exploded perspective view showing an operation lever for the dispenser of the refrigerator.
Figure 5:
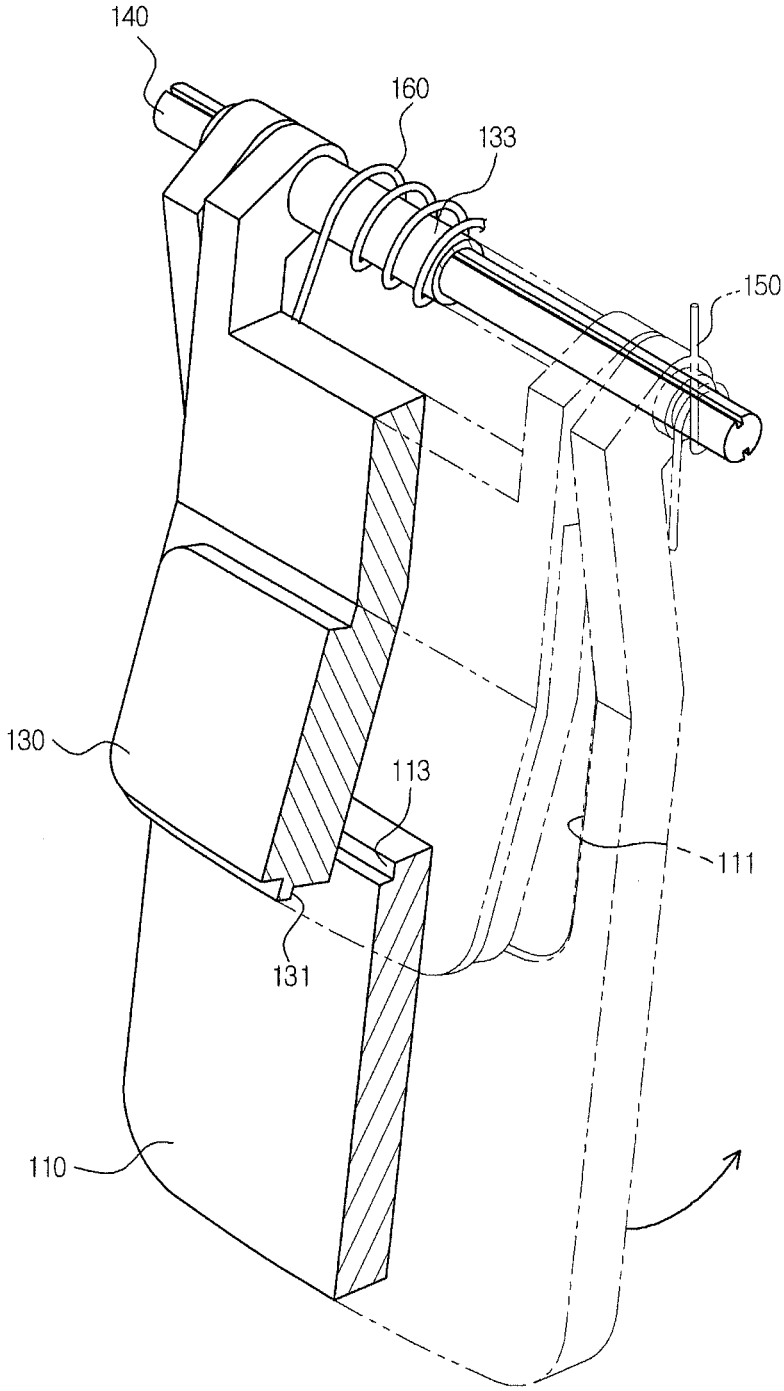
FIG. 5 is a view showing the connection structure of the operation lever for the dispenser.

FIG. 4 is an exploded perspective view schematically showing an operation lever for the dispenser of the refrigerator and FIG. 5 is a view showing the connection structure of the operation lever for the dispenser.

Referring to FIG. 4, the operation lever 100 may include a first lever 110 and a second lever 130 interconnected to perform respectively different functions.

According to the present embodiment, the first lever 110 supplies water from the water tank 40 (FIG. 1) to the dispenser 80 (FIG. 1). The second lever 130 supplies ice from the ice maker 30 (FIG. 2) to the dispenser 80 (FIG. 1). However, not being limited to this embodiment, the first and second levers 110 and 130 may selectively supply hot water and cold water, respectively, or supply different types of ice such as ice cubes and crushed ice.

For this, at least one of the first and second levers 110 and 130 may be moved relative to the other one.

More particularly, according to one embodiment of the operation lever 100 as shown in FIGS. 4 and 5, the first and second levers 110 and 130 are rotatably connected to a rotational shaft 140 but may be structured so that the second lever 130 cannot rotate about the rotational shaft 140 during rotation of the first lever 110.

For this, the first lever 110 is formed larger than the second lever 130, and the second lever 130 is brought into contact with an upper front part of the first lever 110.

That is, the first lever 110 has a cut part 111 opened toward the upper part thereof to insert the second lever 130. A locking protrusion 113 may be formed inwardly along an inner edge of the cut part 111.

Also, a supporting part 131 may be formed along an outer edge of the second lever 130, being depressed by a predetermined depth in the shape corresponding to the locking protrusion 113 so that the second lever 130 is securely supported by the locking protrusion 113.

A rotational shaft hole 115 is formed at the upper part of the first lever 110 for connection with the rotational shaft 140. An insertion rib 117 is formed on an inner circumference of the rotational shaft hole 115 to be inserted in an insertion groove 141 formed at the rotational shaft 140, such that the first lever 110 and the rotational shaft 140 rotate together.

Additionally, a first elastic member connection part 119 is protruded outward on both upper surfaces of the first lever 110 to connect a first elastic member 150 which returns the first lever 110 in a rotated state to its initial state.

The first elastic member 150 may be a torsion spring of which one end is supported by the first lever 110 and the other end is supported by the case 81 (FIG. 3) of the dispenser 80 (FIG. 3).

A rotational shaft insertion part 133 is formed at an upper part of the second lever 130, including a center hole 135 with a greater diameter than the rotational shaft 140 to receive the rotational shaft 140. On an outer circumference of the rotational shaft insertion part 133, a second elastic member 160 may be formed to exert elasticity in the opposite direction to the rotational direction of the first lever 100 to thereby restrict rotation of the second lever 130 while the first lever 110 is rotating.

The second elastic member 160 may be a torsion spring supported by the second lever 130 with one end thereof and supported by the case 81 (FIG. 3) of the dispenser 80 (FIG. 3) on the other end. However, one or more embodiments, not being limited to this case, may adopt any other member as long as enabling the second lever 130 to exert a force against the rotational direction of the first lever 110.

As shown in FIGS. 4 and 5, when a user pushes the first lever 110, the first lever 110 is rotated about the rotational shaft 140 whereas the second lever 130 is restrained from rotating since being supported by the second elastic member 160.

When the user pushes the second lever 130, the second lever 130 is rotated together with the first lever 110 since the supporting part 131 of the second lever 130 is supported by the locking protrusion 113 of the first lever 110.

That is, the rotational shaft 140 is rotatably connected to one side of the case 81 (FIG. 3) of the dispenser 80 (FIG. 3) so as to be rotated along with the first lever 110 according to an embodiment. However, both the first and second levers 110 and 130 may be rotatably connected to the rotational shaft 140 while the rotational shaft 140 is static.

Figure 6:
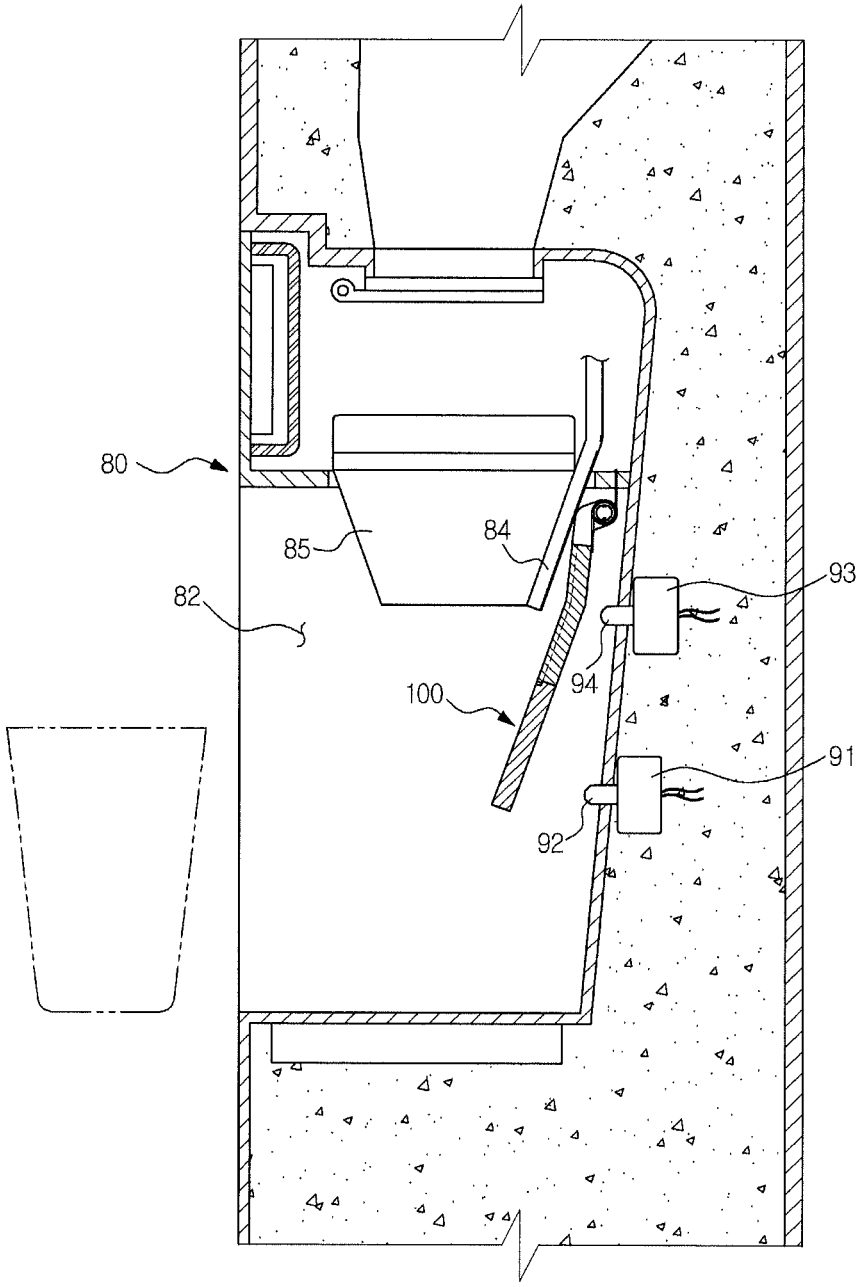
FIG. 6 is a sectional view schematically showing the structure of the operation lever and switches of the dispenser.

FIG. 6 is a sectional view schematically showing the structure of the operation lever and a switch of the dispenser according to one or more embodiments.

Referring to FIG. 6, switches 91 and 93 may be provided at a rear wall of the taking-out space 82 to be operated by the operation lever 100. As the operation lever 100 rotates and therefore pushes first and second operation parts 92 and 94 of the first and second switches 91 and 93, the switches 91 and 93 operate the water supply valve 51 (FIG. 1) or the ice supplying device of the ice maker 30 (FIG. 2), being electrically connected thereto, and thereby discharge water or ice.

The switches 91 and 93 may include a first switch 91 pressed by the first lever 110 (FIG. 5) and a second switch 93 pressed by the second lever 130 (FIG. 5).

The first switch 91 opens the water supply valve 51 (FIG. 1) so that the water in the water tank 40 (FIG. 2) is discharged to the intake port 84, and the second switch 93 operates the ice supplying device of the ice maker 30 (FIG. 2) so that the ice in the ice maker 30 (FIG. 2) is discharged to the ice discharging pipe 85.

Figure 7:
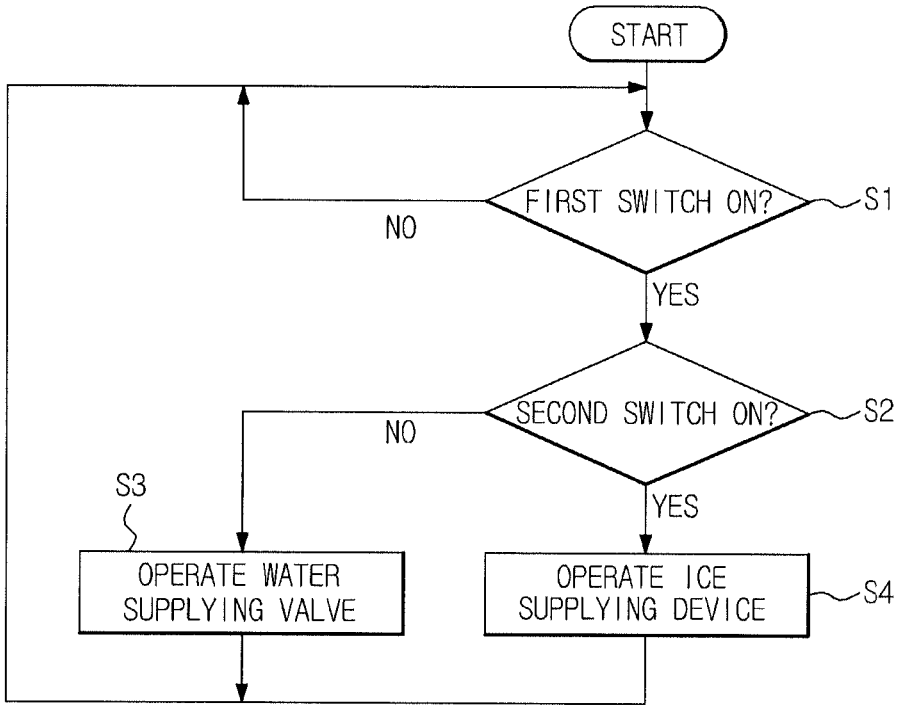
FIG. 7 is a flowchart explaining a controlling method for the refrigerator according to an embodiment.
Figure 8:
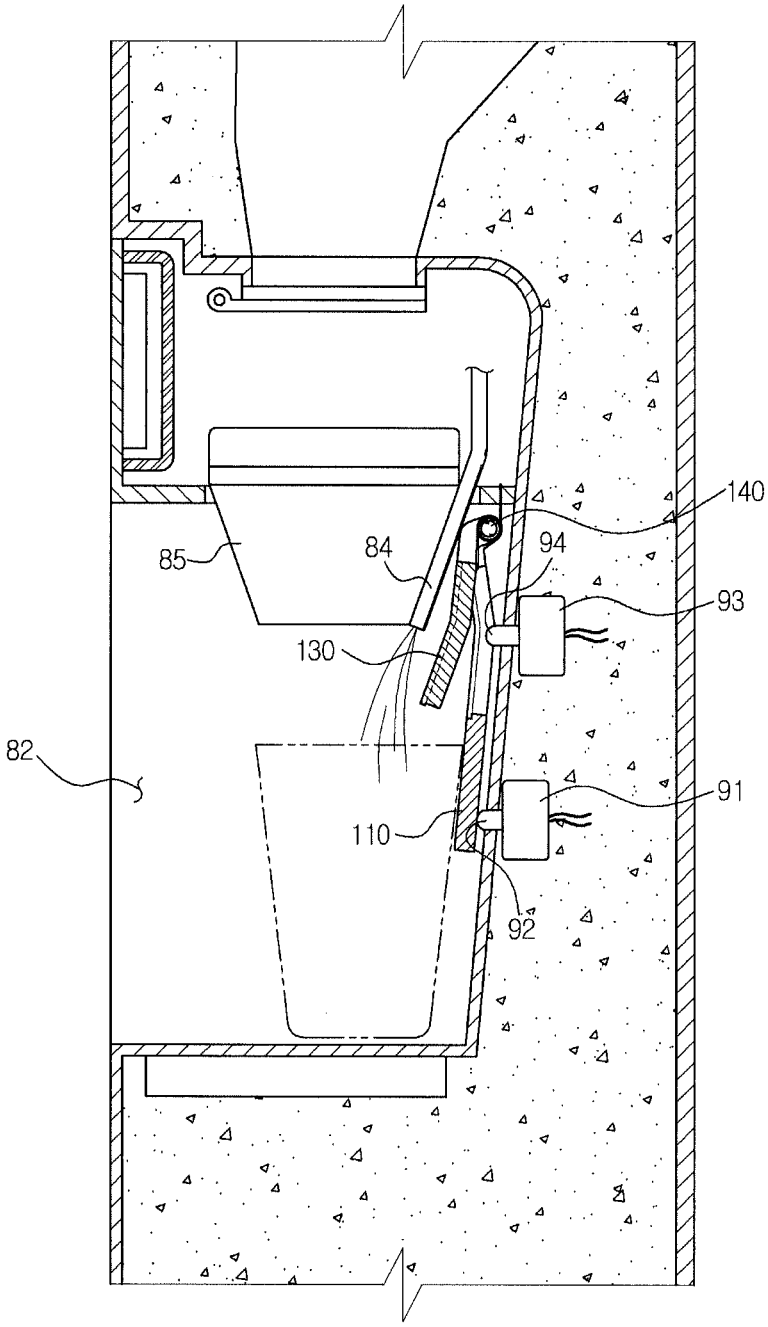
FIG. 8 is a sectional view showing the operation of the dispenser discharging water.
Figure 9:
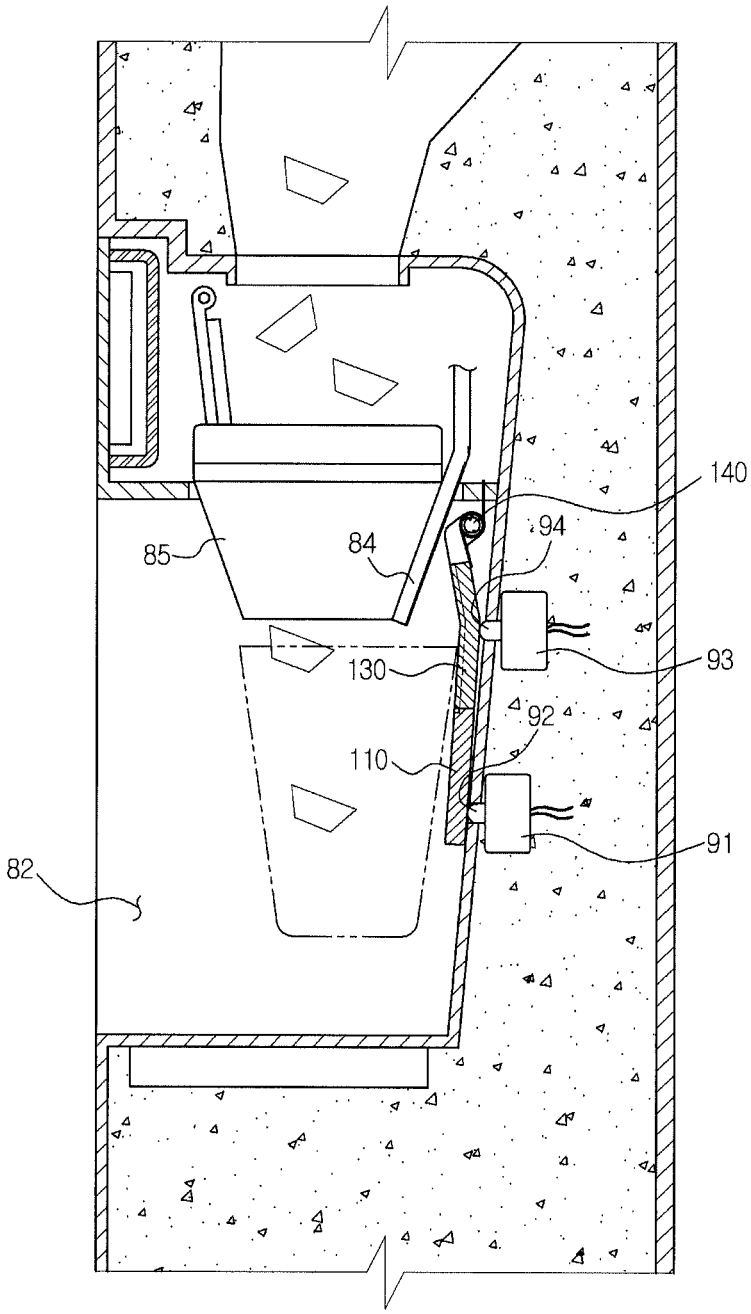
FIG. 9 is a sectional view showing the operation of the dispenser discharging ice.

FIG. 7 is a flowchart explaining a controlling method for the refrigerator according to an embodiment. FIG. 8 is a sectional view showing the operational state of the dispenser which is discharging water. FIG. 9 is a sectional view showing the operational state of the dispenser which is discharging ice.

Referring to FIGS. 6 and 7, first, the control unit (not shown) may discharge water or ice through the dispenser 80 according to signals of the first and second switches 91 and 93 during the operation of the refrigerator.

The control unit (not shown) according to an embodiment may, in operation S1, discharge water or ice according to whether only the first switch 91 is turned on or, in operation S2, according to whether the second switch 93 is also turned on with the first switch 91 turned on.

More specifically, when only the sensing signal of the first switch 91 is detected, in operation S3, the control unit opens the water supply valve 51 (FIG. 1) to discharge water. In operation S4, when the sensing signals of the first and second switches 91 and 93 are both detected, the water supply valve 51 (FIG. 1) is closed and the ice supplying device is operated to discharge the ice.

As shown in FIG. 8, when the user pushes the first lever 110 by putting a cup in the taking-out space 82, the first lever 110 is rotated about the rotational shaft 140, thereby pressing the first operation part 92 of the first switch 91 disposed at the rear wall of the taking-out space 82. However, since the second lever 130 is not rotated at this time, the second operation part 94 of the second switch 93 is inserted in the cut part 111 (FIG. 5) of the first lever 110 and therefore is not pressed.

Accordingly, the dispenser 80 (FIG. 6) supplies water from the water tank 40 (FIG. 1) to the intake port 84.

Meanwhile, referring to FIG. 9, when the user pushes the second lever 130 by putting a cup in the taking-out space 82, the first and the second levers 110 and 130 are rotated, thereby pressing the first and second operation parts 92 and 94 of the first and second switches 91 and 93 disposed at the rear wall of the taking-out space 82. As a result, the ice being discharged from the ice maker 30 (FIG. 2) is supplied into the cup through the ice discharging pipe 85.

Thus, the user may be able to solve inconvenience of dedicatedly pressing a button to select water or ice and then pushing the corresponding lever. Furthermore, since just a single operation lever 100 (FIG. 6) is disposed in the taking-out space 82, space efficiency and aesthetic appearance of the refrigerator may be greatly improved.

Figure 10:
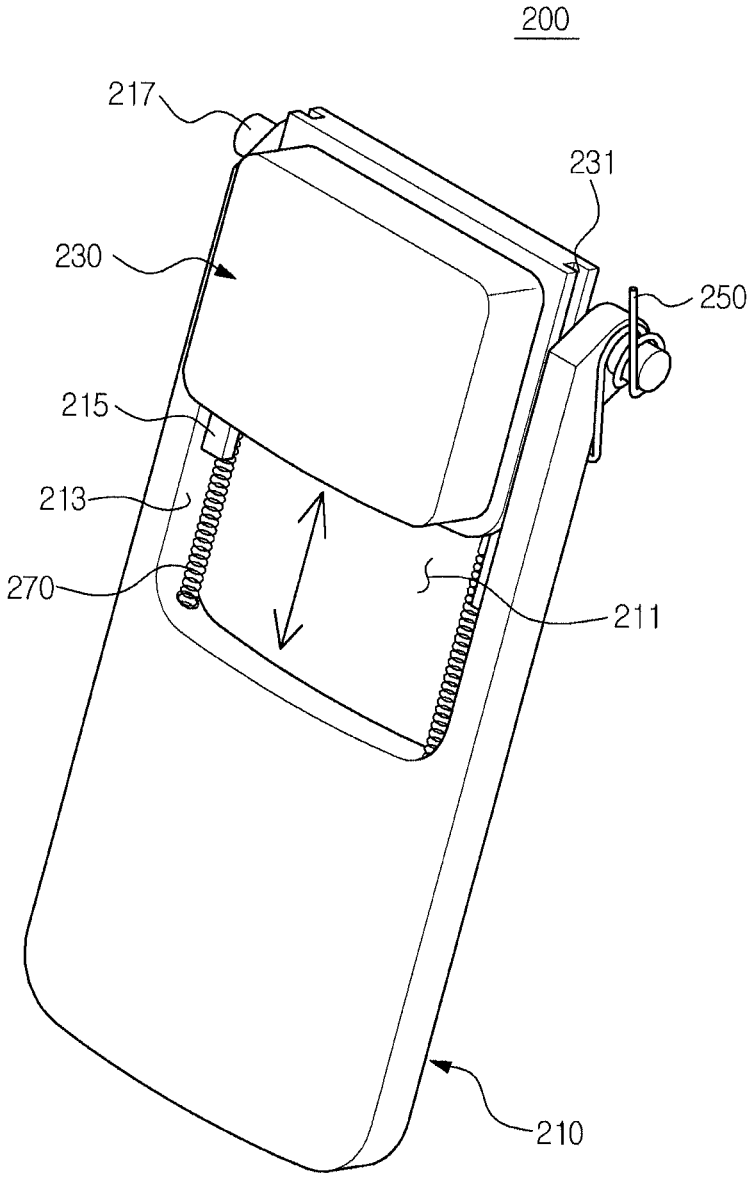
FIG. 10 is a perspective view of an operation lever for a dispenser, according to another embodiment.
Figure 11:
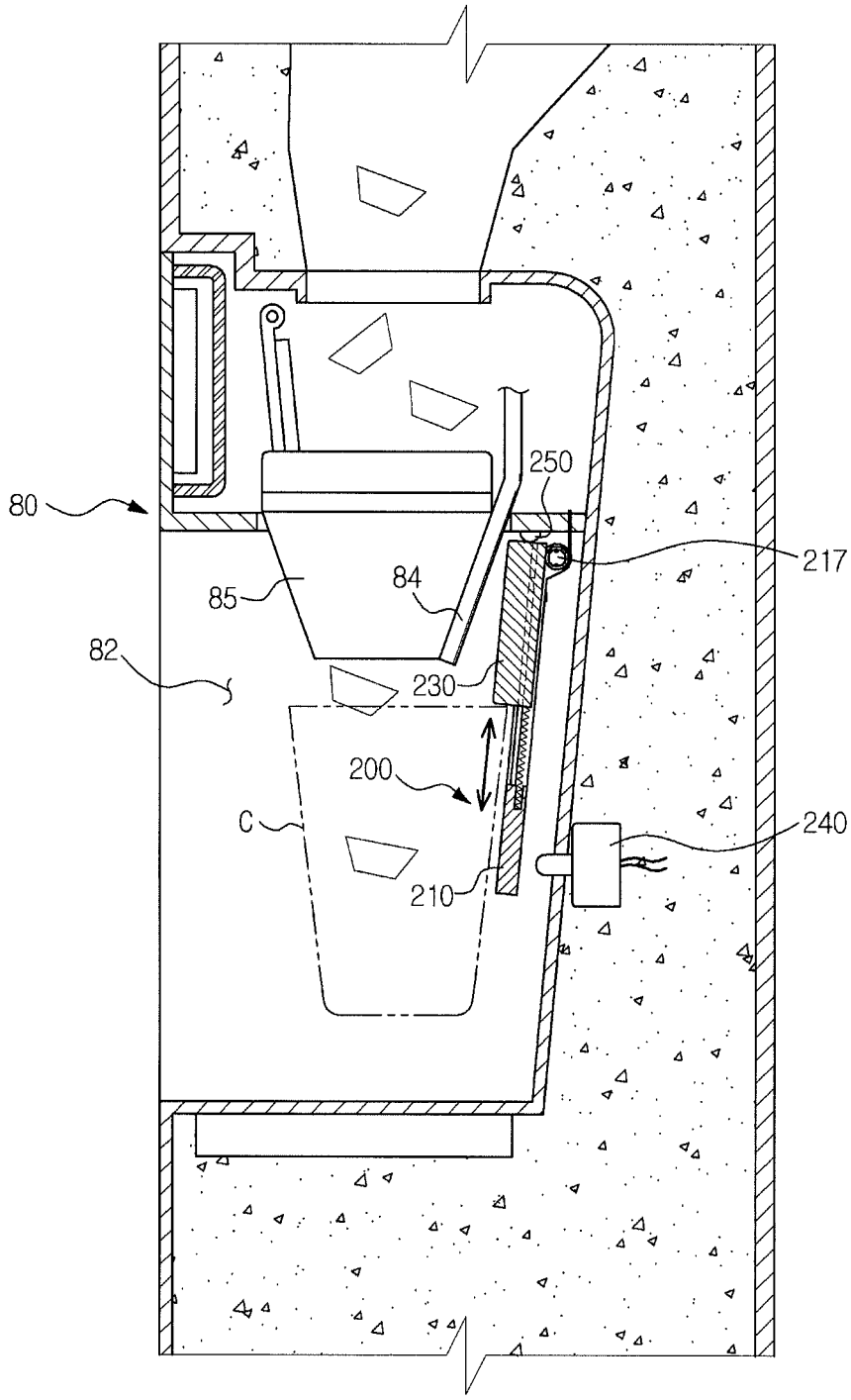
FIG. 11 is a sectional view showing the operational state of the dispenser operation lever of FIG. 10.

FIG. 10 is a perspective view of an operation lever for a dispenser, according to another embodiment, and FIG. 11 is a sectional view showing the operational state of the dispenser operation lever of FIG. 10. Hereinafter, structures having the same functions as described above will be cited by the same reference numerals while omitting detailed explanation thereof.

According to this embodiment, an operation lever 200 includes a first lever 210 and a second lever 230 which are relatively moved with respect to each other. For example, one of the first and second levers 210 and 230 may be slid with respect to the other one.

Specifically, guide rails 215 are formed on both inner sidewalls 213 of a cut part 211 opened toward an upper part of the first lever 210. Slide grooves 231 are formed on both sides of the second lever 230 that will be disposed in the cut part 211, to be slid up and down along the guide rails 215.

In addition, a second elastic member 270 such as a coil spring may be formed so that the second lever 230 may return to its initial position after being moved.

In this embodiment, switches for discharge of water and ice may be provided at a rear part of the first lever 210 and at an upper part of the lever 230, respectively, to function independently.

More particularly, as shown in FIGS. 10 and 11, the first lever 210 may be rotated about a rotational shaft 217 to thereby push an operation part of a first switch 240 disposed at the rear part of the first lever 210, so that the water is discharged to the dispenser 80. The second lever 230 may be slid along the guide rail 215 of the first lever 210, thereby pushing an operation part of a second switch 250 disposed at the upper part of the taking-out space 82 so that the ice is discharged to the dispenser 80.

Aspects of one or more embodiments are not limited to the above description but may further include a following embodiment.

In one or more embodiments, the second lever is slid relative to the first lever forward and backward or up and down. However, the second lever may be rotated in lateral directions with respect to the first lever.

In addition, although one or more embodiments have the switches respectively to sense the operations of the first and second levers, a two-way switch capable of performing two functions may be provided to selectively discharge water or ice by being connected to different contact points according to a pressing force of the levers.

In this case, a pressing protrusion may be further provided at the second lever to press a button of the two-way switch so that the pressing force is varied according to the rotation of the first and second levers.

Figure 12:
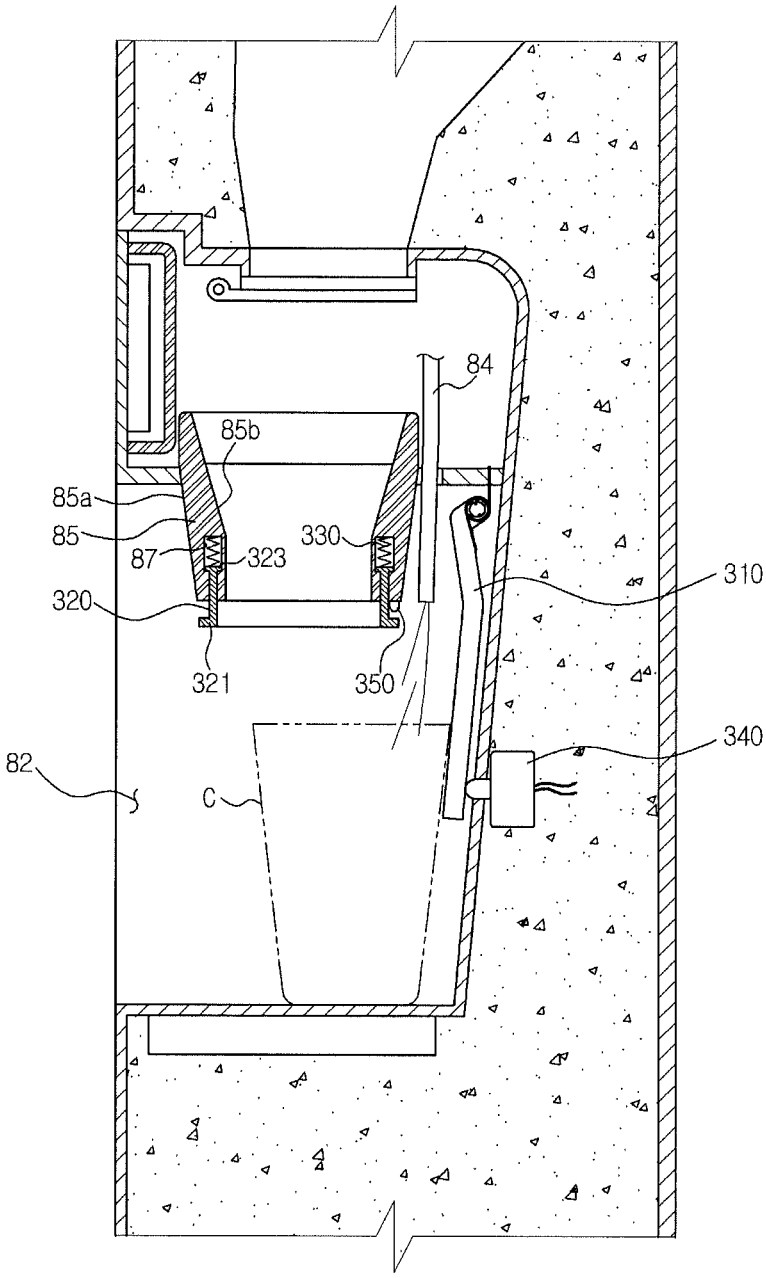
FIG. 12 is a sectional view showing an operation lever for a dispenser, according to still another embodiment.
Figure 13:
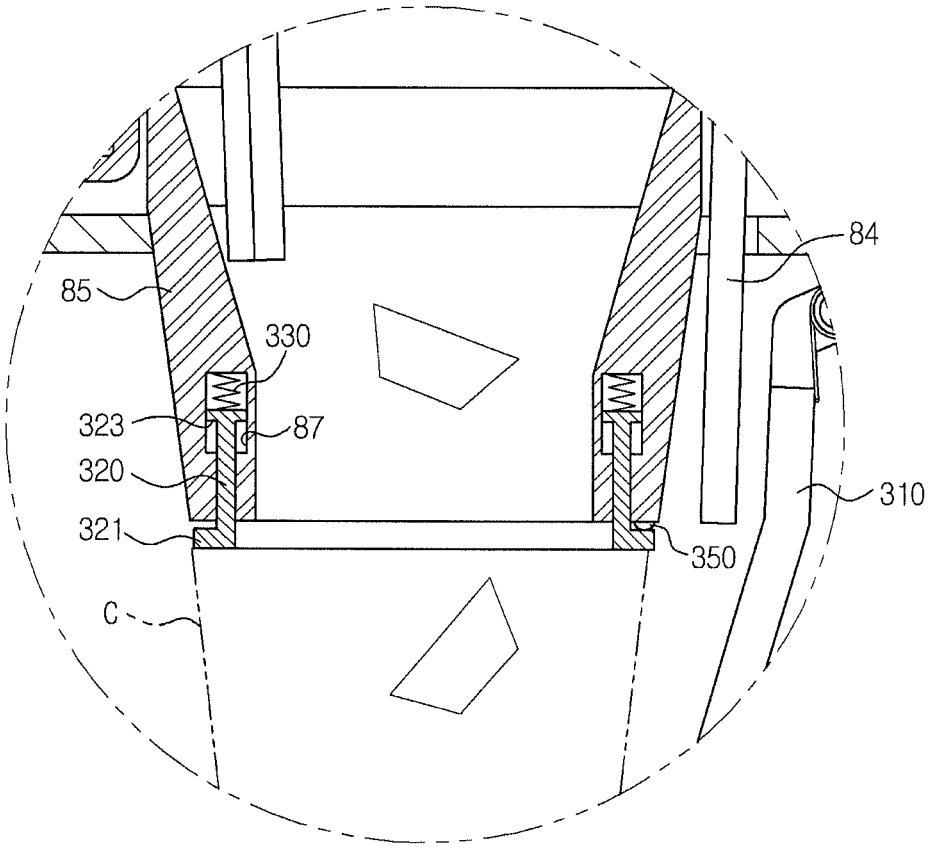
FIG. 13 is a partially enlarged view showing the operational state of the operation lever of FIG. 12.

FIG. 12 is a sectional view of an operation lever for a dispenser, according to still another embodiment and FIG. 13 is a partially enlarged view showing the operational state of the dispenser operation lever of FIG. 12. Hereinafter, structures having the same function as described above will be cited by the same reference numerals and not be explained in detail.

Referring to FIG. 12, an operation lever may include separate levers, that is, a first lever 310 to discharge beverage to the intake port 84 and a second lever 320 to discharge ice to the ice discharging pipe 85.

The first lever 310 is rotatably connected to one side of the taking-out space 82 to press a first switch 340 disposed at one side of a rear wall of the taking-out space 82. The second lever 320 is moved in an up and down direction at a lower part of the ice discharging pipe 85 so as to press a second switch 350 formed at one lower side of the ice discharging pipe 85.

The second switch 350 may be implemented by a general switch or a sensor that senses the movement of the second lever 320.

A connection groove 87 may be formed at the ice discharging pipe 85 for one end of the second lever 320 to be moved forward and backward therein. The connection groove 87 may be formed in a circumferential direction between an outer surface 85*a* and an inner surface 85*b* of the ice discharging pipe 85, thereby supplying a space so that the second lever 320 is moved in the space as pushed.

The second lever 320 has a cylindrical form opened through the center. A push part 321 is formed at an end of the second lever 320 to push an upper end of a cup C inserted in the taking-out space 82. A connection part 323 is formed at the other end of the second lever 320, which is inserted in the connection groove 87 to be movable up and down and supported by a lower edge of the connection groove 87.

The connection part 323 may have a flange form extended from the other end of the second lever 320 in a radial direction to have a similar diameter to an inner diameter of the connection groove 87.

Meanwhile, the connection groove 87 has an elastic member 330 to return the second lever 320 being pushed, to its initial position.

The elastic member 330 may be a coil spring of which one end is supported by an upper end of the connection groove 87 and the other end is supported by the connection part 323 of the second lever 320. The elastic member 330 pushes the second lever 320 downward.

According to the above structure, as shown in FIG. 12, the user pushes the first lever 310 with the cup C when he or she wants to take out beverage from the taking-out space 8. Therefore, the first lever 310 presses the first switch 340 disposed at the one side of the rear wall of the taking-out space 82, thereby supplying the purified beverage from the intake port 84 to the cup C.

In addition, referring to FIG. 13, when the user wants to take out ice, the user may bring the cup C into contact with the push part 321 of the second lever 320 and push the cup C upward, so that the second lever 320 is moved to the upper part of the ice discharging pipe 85 and presses the second switch 350 disposed at one lower side of the ice discharging pipe 85. Accordingly, the user is supplied with the ice discharged to the ice discharging pipe 85.

When the cup C is removed afterward, the elastic member 330 pushes the second lever 320 downward, thereby returning the second lever 320 to the initial position and relieving the second switch 350 from the pressing force.

Thus, the user may be able to take out beverage or ice through a simple operation by providing the operation lever which improves user convenience.

Figure 14:
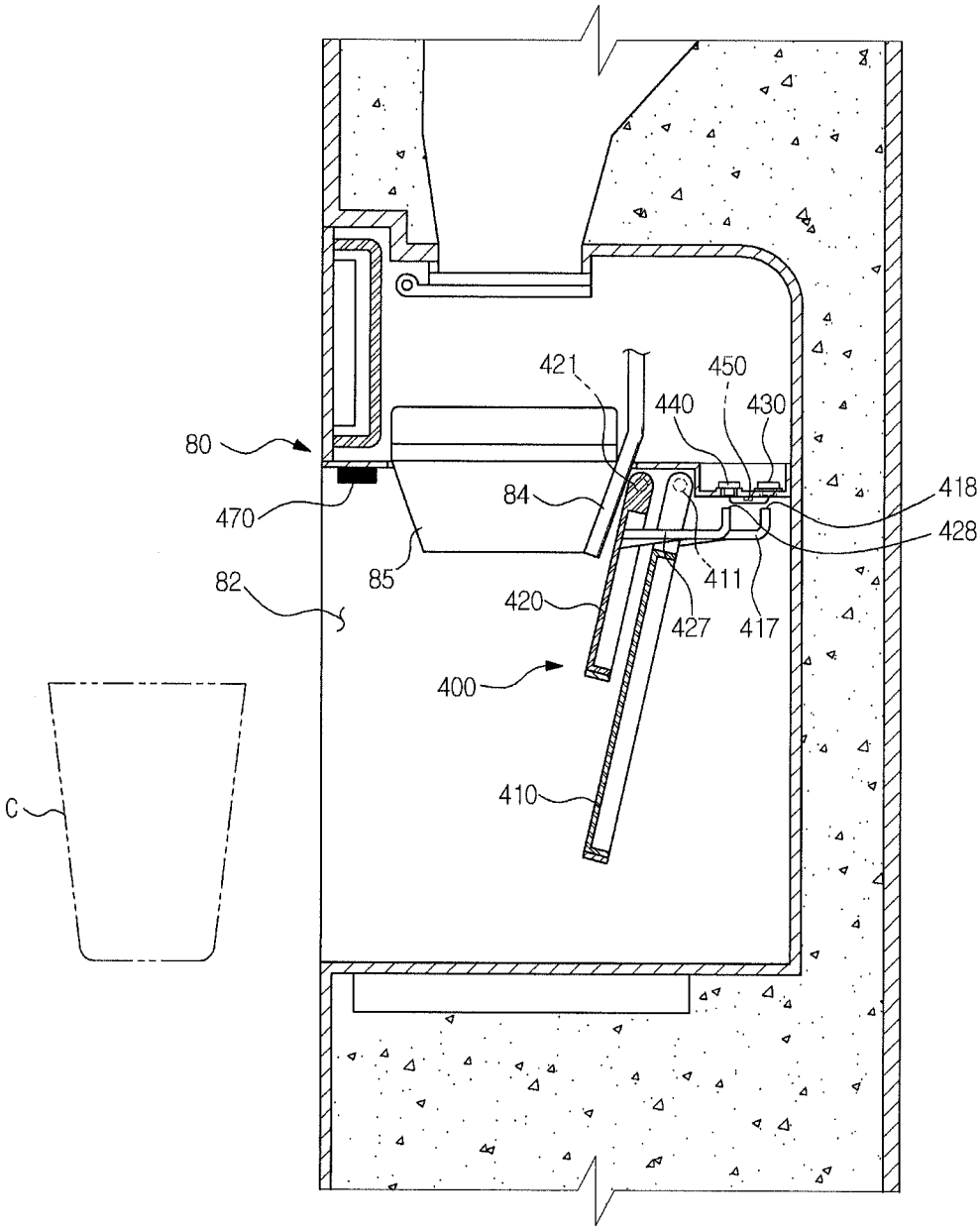
FIG. 14 is a sectional view showing parts of the dispenser in the refrigerator according to another embodiment.
Figure 15:
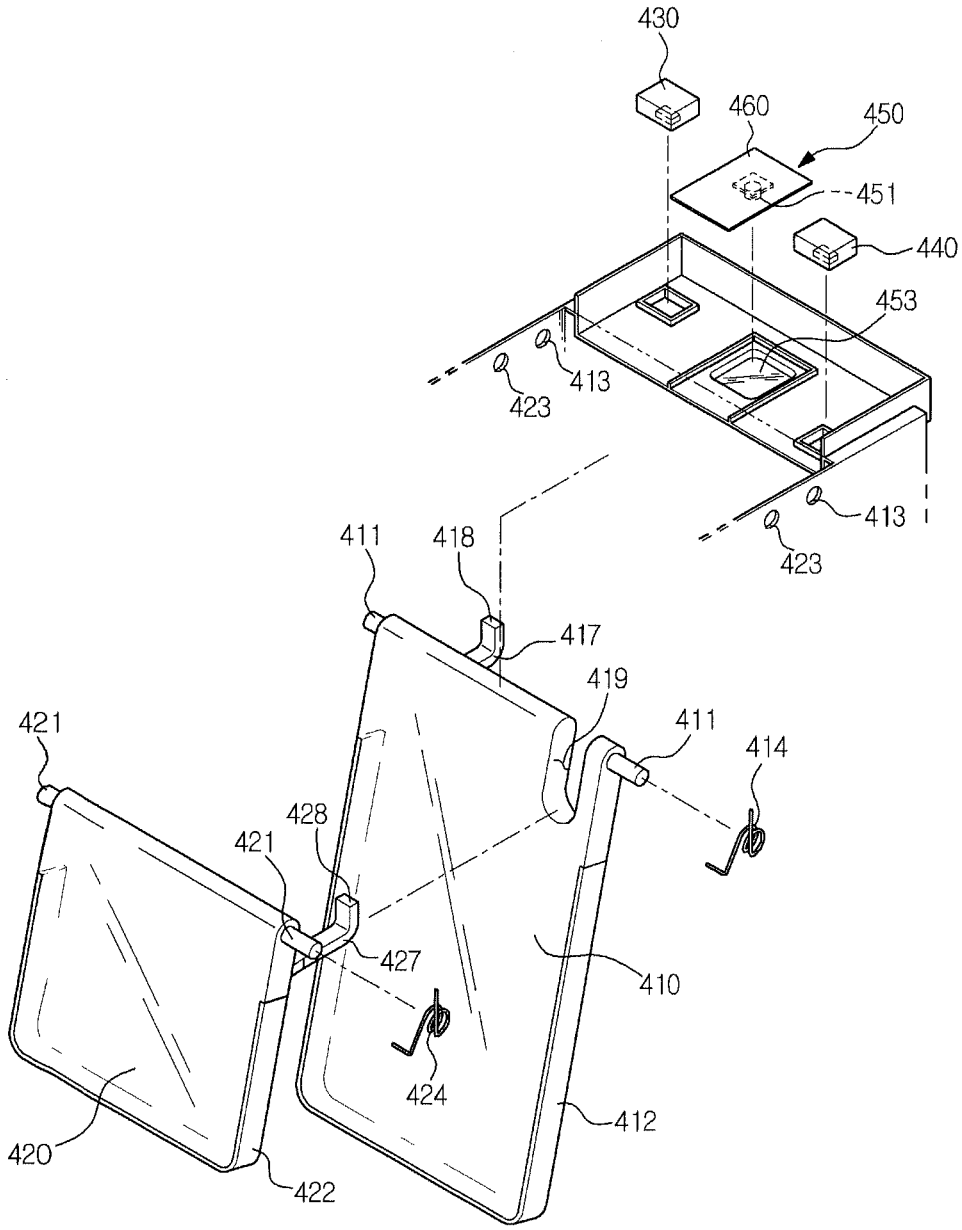
FIG. 15 is an exploded perspective view showing an operation lever for the dispenser according to the embodiment of FIG. 14.

FIG. 14 is a sectional view showing parts of the dispenser in the refrigerator according to another embodiment. FIG. 15 is an exploded perspective view showing an operation lever for the dispenser according to the embodiment of FIG. 14. In the following description, constituent elements having the same function are designated by the same reference numeral, and no detailed description thereof will be given.

Referring to FIGS. 14 and 15, the dispenser 80 includes an operation lever 400. The operation lever 400 may include a first lever 410 to rotate about first rotational shafts 411 at the upper portion of the taking-out space 82, and a second lever 420 to rotate about second rotational shafts 421 at the upper portion of the taking-out space 82.

The first and second levers 410 and 420 may be disposed to face each other while being spaced apart from each other in forward and backward directions. The second lever 420 has a shorter length than the first lever 410. The second lever 420 may be disposed to rotate in front of the first lever 410.

The first and second levers 410 and 420 may be formed using a plate made of a transparent or opaque resin material. Finishing members 412 and 422 made of a metal material may be disposed along peripheries of the first and second levers 410 and 420, respectively.

The first rotational shafts 411 may be disposed at opposite sides of an upper end of the first lever 410, respectively. The second rotational shafts 421 may be disposed at opposite sides of an upper end of the second lever 420, respectively. The first and second rotational shafts 411 and 421 may be fitted in axial grooves 413 and 423 provided at the upper portion of the taking-out space 82.

The first lever 410 rotates about the first rotational shafts 411. A first elastic member 414 may be provided at the first rotational shaft 411, to elastically support the first lever 410 such that the first lever 410 is forcibly returned to an initial position thereof after rotating. The first elastic member 414 may be comprised of a torsion spring having one end supported by an upper wall of the taking-out space 82 and the other end supported by the first lever 410.

The second lever 420 rotates about the second rotational shafts 421. A second elastic member 424 may be provided at the second rotational shaft 421, to elastically support the second lever 420 such that the second lever 420 is forcibly returned to an initial position thereof after rotation. The second elastic member 424 may be comprised of a torsion spring having one end supported by an upper wall of the taking-out space 82 and the other end supported by the second lever 420.

When the second lever 420 rotates about the second rotational shafts 421, the second lever 420 presses the first lever 410 after rotating a predetermined rotational angle. This is because the first and second levers 410 and 420 are disposed to be spaced apart from each other by a predetermined distance in forward and backward directions. As the second lever 420 rotates while pressing the first lever 410, they rotate together.

Meanwhile, a circuit board 460 may be provided at a rear upper portion of the taking-out space 82. The circuit board 460 may include first and second switches 430 and 440, which may be pressed by the first and second levers 410 and 420, respectively, and an illuminator 450 to irradiate light toward the taking-out space 82.

The illuminator 450 may include a light emitter 451 installed on the circuit board 460, and a transparent window 453 surrounding the light emitter 451, to protect the light emitter 451 from the surroundings while allowing light emitted from the light emitter 451 to be gently spread.

The illuminator 450 is not limited in terms of the light source to emit illumination light to the taking-out space 82, the material of the transparent window, and the structure of the transparent window. For example, the light emitter 451 may be comprised of one of an LED lamp, an incandescent electric lamp, a halogen lamp, and a fluorescent lamp. The transparent window 453 may be dispensed with.

Meanwhile, a first operation arm 417 and a second operation arm 427 may be disposed at upper portions of back surfaces of the first and second levers 410 and 420, to operate the first and second switches 430 and 440, respectively.

The first operation arm 417 may include a first contact member 418 backwardly extended from the back surface of the first lever 410 and then bent upwardly. The second operation arm 427 may include a second contact member 428 backwardly extended from the back surface of the second lever 420 and then bent upwardly.

The first contact member 418 may be disposed at a position facing the first switch 430. The second contact member 428 may be disposed at a position facing the second switch 440.

The first lever 410 may be provided, at one side of the upper end thereof, with a cut part 419, through which the second operation arm 427 extends. The second contact member 428 of the second operation arm 427 may extend through the cut part 419 such that the second contact member 428 is disposed at a position near the second switch 440.

Meanwhile, a sensor 470 may be disposed at a front upper portion of the taking-out space 82, to sense approach of an object to the interior of the taking-out space 82. The sensor 470 may be comprised of an approach sensor to sense approach of an object. The sensor 470 may be operatively connected to the illuminator 450.

Figure 16:
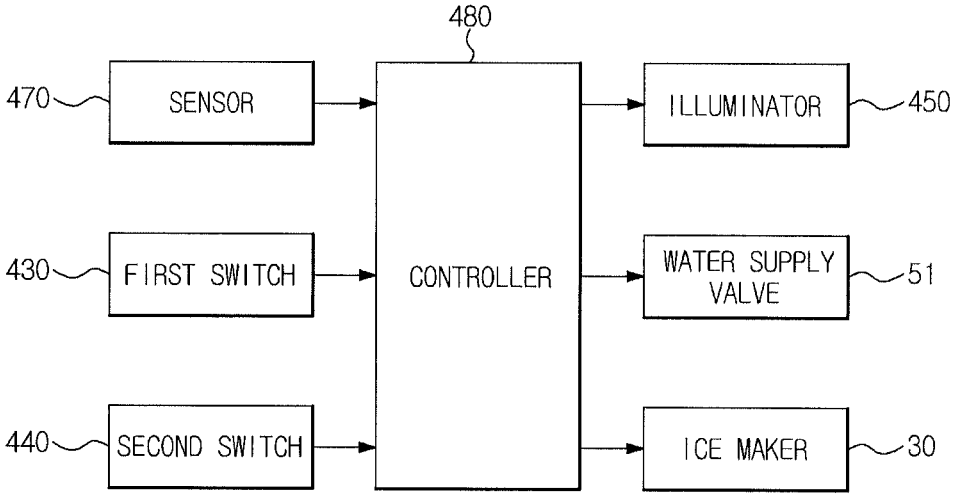
FIG. 16 is a block diagram of a control configuration of the refrigerator according to another embodiment.

FIG. 16 is a block diagram of a control configuration of the refrigerator according to another embodiment. The refrigerator includes a controller 480, in addition to the sensor 470, first switch 430, second switch 440, illuminator 450, water supply valve 51, and ice maker 30.

The sensor 470 may include an approach sensor. The approach sensor 470 may sense approach of an object including the hand of the user. When the approach sensor 470 senses approach of an object, it outputs a corresponding signal to the controller 480 which, in turn, controls the color, intensity of illumination, flicker pattern, etc. of the illuminator 450, based on the sensing signal.

The first and second switches 430 and 440 are actuated by the operation lever 400, to output detection signals to the controller 480. Based on the detection signals, the controller 480 may control the water supply valve 51 and the ice supplier of the ice maker 30.

The controller 480 may operate the water supply valve 51 when it receives only the detection signal from the first switch 430, in order to control the dispenser 80 to dispense beverage. When the controller 480 receives only the detection signal from the second switch 440, or receives both the detection signals from the first and second switches 430 and 440, it may control the ice supplier of the ice maker 30 to operate such that ice is supplied to the dispenser 80.

Figure 17:
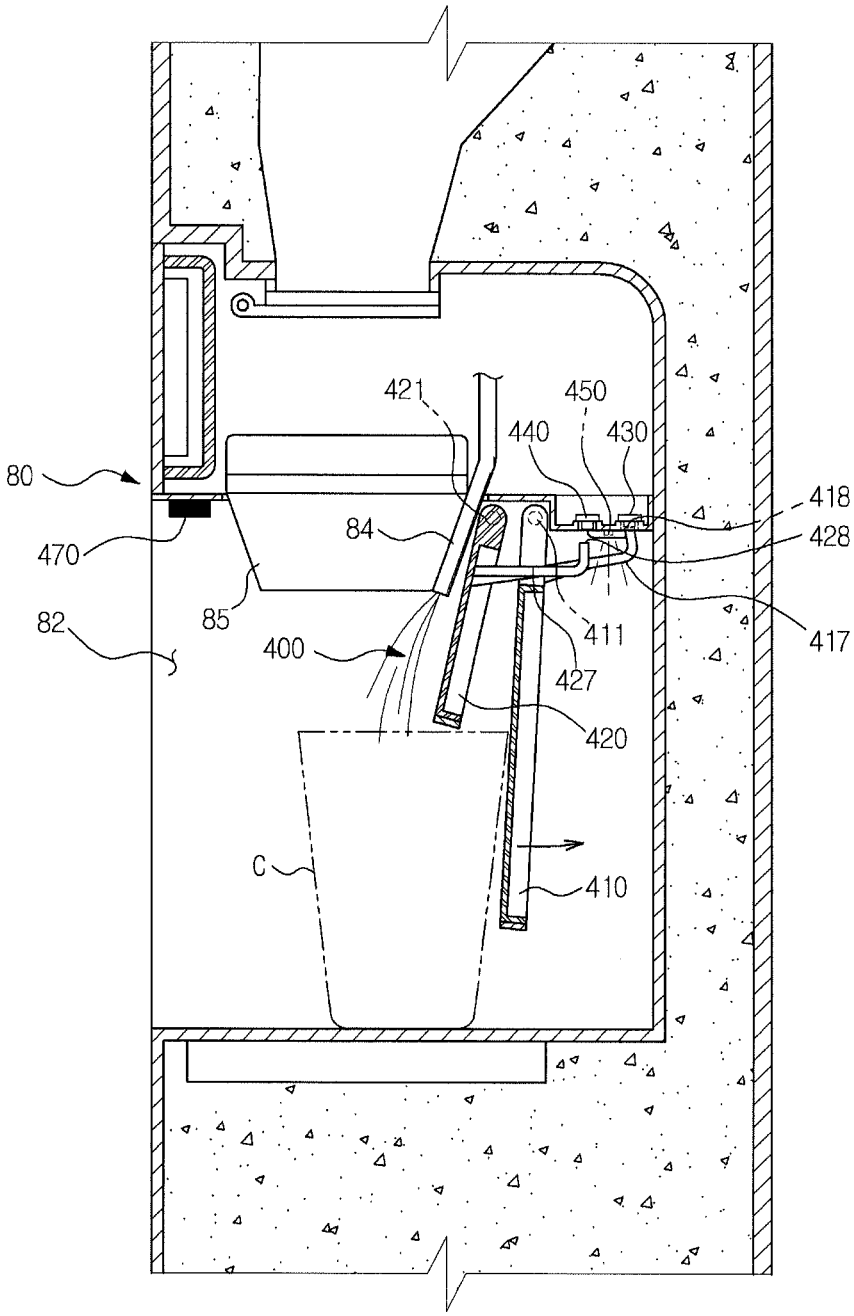
FIG. 17 is a sectional view showing operation of the dispenser according to the embodiment of FIG. 14.

FIG. 17 shows operation of the dispenser according to the embodiment of FIG. 14.

When the user puts a cup into the taking-out space 82, in order to receive water or ice from the dispenser 80, the sensor 470 senses approach of the cup, and outputs a sensing signal to the controller 480. Based on the sensing signal, the controller 480 operates the illuminator 450.

The illuminator 450 emits light, thereby illuminating the taking-out space 82. Thus, the user may easily identify the operation lever 400. Where the operation lever 400 is made of a light-transmitting resin material, a gentle mood effect may be obtained.

When the first lever 410 is then pressed, it rotates about the first rotational shafts 411, thereby causing the first operation arm 417 to operate the first switch 430.

As a result, the first switch 430 outputs a detection signal to the controller 480. Based on the detection signal, the controller 480 operates the water supply valve 51 such that beverage is discharged to the dispenser 80.

On the other hand, when the second lever 420 is pressed, it rotates about the second rotational shafts 421 by a predetermined rotational angle, thereby operating the second switch 440. When the second lever 420 is further pressed, it presses the first lever 410, thereby operating the first switch 430.

In this case, both the first and second switches 430 and 440 output detection signals to the controller 480. Based on the detection signals, the controller 480 controls the ice maker 30 to operate such that ice is discharged to the dispenser 80.

In this case, the controller 30 may operate the ice maker 30 when it detects both the operation of the first switch 430 and the operation of the second switch 440, irrespective of the order of operation detection, for example, the case in which operation the second switch 440 is first detected, or the case in which operation of the first switch 430 is detected after detection of the operation of the second switch 440.

As is apparent from the above description, an operation lever for a dispenser according to one or more embodiments does not dedicatedly need a function conversion button to select whether to take out ice or water from the dispenser. Accordingly, user convenience may be improved.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An operation lever for a dispenser, comprising a first lever and a second lever interconnected to press a first switch and a second switch, respectively;

wherein an interconnection of the first lever and the second lever provides operation of the first lever without moving the second lever upon only the first lever being operated to press the first switch, and provides the second lever being moved along with the first lever upon the second lever being operated to press the second switch.

2. The operation lever according to claim 1, further comprising a rotational shaft to which the first and the second levers are rotatably connected, and the second lever is formed to have a shorter length than the first lever and disposed in front of the first lever.

3. The operation lever according to claim 2, further comprising:

a first elastic member elastically supporting the first lever to return the first lever to an initial position after being rotated; and a second elastic member elastically supporting the second lever in an opposite direction to the rotational direction of the first lever to restrict rotation of the second lever while the first lever is rotating.

4. The operation lever according to claim 2, wherein the first lever comprises:

a cut part opened to one side; and a locking protrusion formed along an inner edge of the cut part to be supported by a supporting part recessed along an edge of the second lever.

5. The operation lever according to claim 1, wherein the second lever is rotated about a rotational shaft, and the first lever is connected to be rotated along with and slid with respect to the second lever.

6. The operation lever according to claim 5, wherein the second lever comprises a cut part opened to an upper part thereof and guide rails formed on both inner sidewalls of the cut part, and the first lever comprises slide grooves engaged with the guide rails.

7. The operation lever according to claim 6, further comprising:

a first elastic member to return the second lever in a rotated state to an initial state; and a second elastic member to return the first lever in a moved state to an initial position.

8. An operation lever for a dispenser, comprising:

a first lever to rotate about a first rotational shaft;

a second lever to rotate about a second rotational shaft, the second lever being formed to have a shorter length than the first lever while being disposed in front of the first lever;

first and second elastic members to elastically support the first and second levers such that the first and second levers are returned to initial positions thereof after rotating, respectively; and first and second switches to be pressed by the first and second levers when the first and second levers rotate, respectively.

9. A refrigerator comprising:

a main body equipped with a storage chamber;

a door opening and closing the storage chamber;

a dispenser formed at one side of the door to enable taking-out of beverage and ice from outside;

first and second switches formed at one side of the dispenser for taking-out of the beverage and ice; and an operation lever pressing the first and second switches, wherein the operation lever includes a first lever and a second lever rotatable to press the first and second switches, wherein the second lever does not rotate even when the first lever presses the first switch, wherein the second lever presses the first lever as the second lever rotates to press the second switch, wherein the second lever rotates along with the first lever as the second lever presses the first lever.

10. The refrigerator according to claim 9, further comprising:

first and second elastic members to return the first and second levers to initial positions thereof after rotating, respectively, the first and second elastic members being coupled to respective rotational shafts of the first and second levers.

11. The refrigerator according to claim 10, wherein:

the first and second switches are disposed at a rear upper portion of a taking-out space of the dispenser; and first and second operation arms are disposed at back surfaces of the first and second levers while extending toward the first and second switches, respectively.

12. The refrigerator according to claim 11, wherein:

the second lever comprises a partially-opened cut part formed at one side of the first lever; and the second operation arm extends toward the second switch while extending through the cut part.

13. The refrigerator according to claim 9, further comprising:

an illuminator to illuminate a taking-out space of the dispenser; and a sensor to sense approach of an object into the taking-out space, wherein the illuminator is operatively connected to the sensor.

14. A refrigerator comprising:

a main body equipped with a storage chamber;

a door opening and closing the storage chamber;

a taking-out space disposed at one side of the door;

an ice discharging pipe and an intake port disposed at an upper part of the taking-out space to discharge ice and beverage, respectively;

a first lever rotatably mounted in the taking-out space to press a first switch formed at one side of the taking-out space and thereby to discharge beverage to the intake port; and a second lever mounted at a lower part of the ice discharging pipe and moved in an up and down direction to press a second switch formed at one side of the ice discharging pipe and thereby to supply ice to the ice discharging pipe.

15. The refrigerator according to claim 14, wherein the ice discharging pipe has a connection groove for one end of the second lever to reciprocate therein, and the connection groove has an elastic member to return the second lever in a moved state to an initial position.

16. The refrigerator according to claim 15, wherein the second lever comprises:

a push part formed at one end thereof to push the second lever; and a connection part formed at the other end thereof to be movably inserted in the connection groove and supported by a lower edge of the connection groove.

17. An operation lever for a dispenser, comprising:

a first lever to press the first switch; and a second lever disposed in front of the first lever, to press the second switch, the second lever being formed to have a shorter length than the first lever, wherein the first lever selectively operates to perform a first function without movement of the second lever, or to perform a second function with simultaneous movement of the first and second levers.

18. The operation lever according to claim 17, wherein the first and second levers rotate about rotational shafts thereof, respectively.

19. The operation lever according to claim 17, wherein the first function is to dispense beverage, and the second function is to dispense ice.

20. The operation lever according to claim 17, wherein the first lever and the second lever are pushed to be operated.

21. The operation lever according to claim 17, further comprising an interconnection providing operation of the first lever without moving the second lever upon only the first lever being operated, and providing the second lever being moved along with the first lever upon the second lever being operated.

22. The operation lever according to claim 21, wherein the first and second levers return to an initial position after being operated.

23. The operation lever according to claim 21, wherein the first lever is rotated about a same rotational shaft as the second lever.

24. A refrigerator comprising a dispenser having a taking-out space to discharge ice and beverage, wherein the dispenser comprises:

a first lever rotatably coupled to an upper portion of the taking-out space, to press a first switch;

a second lever rotatably coupled to the upper portion of the taking-out space in front of the first lever, to press the second switch, the second lever having a shorter length than the first lever;

an illuminator to illuminate the taking-out space; and a sensor to sense approach of an object into the taking-out space, wherein the illuminator is operatively connected to the sensor.

* * * * *